US008141659B2

(12) United States Patent
Peters

(10) Patent No.: US 8,141,659 B2
(45) Date of Patent: Mar. 27, 2012

(54) METHOD AND APPARATUS FOR LATERAL WELL DRILLING UTILIZING AN ABRASIVE FLUID STREAM DISCHARGED FROM A ROTATING NOZZLE

(75) Inventor: Jasper N. Peters, Millstadt, IL (US)

(73) Assignee: Latjet Systems LLC, Millstadt, IL (US)

( * ) Notice: Subject to any disclaimer, the term of this patent is extended or adjusted under 35 U.S.C. 154(b) by 399 days.

(21) Appl. No.: 12/350,707

(22) Filed: Jan. 8, 2009

(65) Prior Publication Data

US 2009/0173544 A1 Jul. 9, 2009

Related U.S. Application Data

(60) Provisional application No. 61/019,814, filed on Jan. 8, 2008.

(51) Int. Cl.
*E21B 7/18* (2006.01)

(52) U.S. Cl. ..... 175/62; 175/67; 175/424

(58) Field of Classification Search ..... 175/54, 175/380, 62, 67, 77, 78, 424
See application file for complete search history.

(56) References Cited

U.S. PATENT DOCUMENTS 4,534,427 A * 8/1985 Wang et al. ..... 175/67
6,283,230 B1 * 9/2001 Peters ..... 175/67

* cited by examiner

*Primary Examiner* — David Andrews
(74) *Attorney, Agent, or Firm* — Matthews Edwards LLC

(57) ABSTRACT

A method and apparatus for penetrating a side of a well casing and/or drilling into earth strata surrounding the well casing, utilizing a rotating fluid discharge nozzle, and an abrasive introduced into the fluid downstream of apparatus for rotating the nozzle. Apparatus for rotating the nozzle can include a motor operable by pressurized fluid, or another suitable rotating power source The introduction of the abrasives will not adversely affect or harm the apparatus for rotating the nozzle, yet will provide the enhanced drilling capability. The abrasive stream can be used for drilling or cutting through a metal well casing, as well as cement and the adjacent strata.

19 Claims, 18 Drawing Sheets

METHOD AND APPARATUS FOR LATERAL WELL DRILLING UTILIZING AN ABRASIVE FLUID STREAM DISCHARGED FROM A ROTATING NOZZLE

This application claims the benefit of U.S. Provisional Patent Application Ser. No. 61/019,814, filed Jan. 8, 2008.

TECHNICAL FIELD

This invention relates generally to methods and apparatus for penetrating a side of a well casing and/or drilling into earth strata surrounding the well casing, and more particularly, to an improved method and apparatus for drilling into the surrounding earth strata utilizing a rotating fluid discharge nozzle, and use of an abrasive introduced into the fluid downstream of apparatus for rotating the nozzle.

BACKGROUND ART

The disclosures of Peters U.S. Pat. No. 6,283,230 entitled METHOD AND APPARATUS FOR LATERAL WELL DRILLING UTILIZING A ROTATING NOZZLE, issued Sep. 4, 2001, and U.S. Provisional Patent Application Ser. No. 61/019,814, filed Jan. 8, 2008, are hereby incorporated by reference in their entirety.

A large number of wells have been drilled into earth strata for the extraction of oil, gas, and other material therefrom. In many cases, such wells are found to be initially unproductive, or decrease in productivity over time, even though it is believed that the surrounding strata still contains extractable oil, gas or other material. Such wells are typically vertically extending holes including a casing usually of mild steel pipe having an inner diameter of from just a few inches to about eight (8) inches in diameter for the transportation of the oil, gas or other material upwardly to the earth's surface.

In an attempt to obtain production from unproductive wells and increase production in under producing wells, methods and apparatus for cutting a hole in the well casing and forming a lateral passage therefrom into the surrounding earth strata are known. Reference for instance, Landers U.S. Pat. No. 5,413,184 issued May 9, 1995; and Schellsteed U.S. Pat. No. 4,640,362 issued Feb. 3, 1987, which disclose exemplary methods and apparatus for producing lateral holes in the earth's strata surrounding a well casing. However, such known methods and apparatus have not yet been known to provide satisfactory results. In particular, the known apparatus of Landers utilizes a non-rotating blasting type fluid nozzle wherein fluid under pressure is directed at the earth's strata has been found to be unable to produce a hole in the strata of more than a few inches in depth. This shortcoming is believed to be due largely to the inability of the non-rotating blaster type nozzles to form a passage in the strata sufficiently unobstructed to allow advancement of the nozzle into the strata, particularly in strata having suitable porosity and permeability characteristics for oil, gas and/or other commercial products.

Reference also Buckman U.S. Pat. No. 6,263,984, which discloses several embodiments of fluid nozzles for lateral drilling, rotatable by fluid flow discharged from the nozzle. However, observed shortcomings of these devices include that abrasives contained in the fluid flow can abrade structural elements of the nozzles to possibly result in degradation of performance and/or failure thereof.

Accordingly, the present invention is directed to overcoming one or more of the problems as set forth above.

DISCLOSURE OF THE INVENTION

What is disclosed is apparatus and a method which overcomes one or more of the problems and shortcomings set forth above.

According to a preferred aspect of the invention, a length of tube or tubing adapted for lowering into a well bore, is supported by apparatus operable for rotating the tubing. Such apparatus can include, but is not limited to, a motor operable by pressurized fluid, or another suitable rotating power source. The motor is preferably lowerable into the well bore with the tubing. The tubing has a free end including a nozzle. The tubing and nozzle are configured to be rotated by the apparatus, as a fluid is directed through the tubing so as to be discharged through the nozzle, for performing a drilling function. To increase the drilling capability, particles of an abrasive are introduced into the fluid stream, upstream of the discharge opening or openings of the nozzle, but downstream of the apparatus for rotating the tubing. As a result, the introduction of the abrasive will not adversely affect or harm the apparatus for rotating the nozzle and tubing, yet will provide the enhanced drilling capability. The abrasive stream can be used for drilling or cutting through a metal well casing, as well as cement and the adjacent strata.

According to another preferred aspect of the invention, the tubing, at a location below the apparatus for rotating the tubing, includes a first orifice connecting the interior of the tubing with a reservoir or source of the abrasive. A second orifice connecting the interior of the tubing with the reservoir, is located downstream of the first orifice. The tubing between the first and second orifices, and/or one or both of the orifices themselves, is configured for reducing fluid pressure in the second orifice compared to the first orifice. As a result, in operation, abrasive from the reservoir or source will enter the fluid stream so as to flow to the nozzle and be discharged therefrom with the fluid stream, for enhancing the drilling operation.

According to still another preferred aspect of the invention, the tubing can include a closure apparatus configured and operable for covering at least one of the first orifice and the second orifice when the pressurized fluid flow is absent. For example, the closure apparatus can include a biasing element which automatically operates for holding a cover element in covering relation to the at least one of the orifices when the pressurized fluid flow is absent, the biasing element being resiliently yieldable responsive to application of a force thereagainst by the pressurized fluid for automatically moving the covering element out of the covering relation.

According to another preferred aspect of the invention, a flow of fluid carrying abrasives, for instance in a second tube, can be merged with the flow of pressurized fluid below or downstream from the apparatus for rotating the nozzle, for providing the advantages of the invention.

And, according to a still further aspect of the invention, for deeper wells wherein a hydrostatic head will adversely affect drilling, all or a portion of the hydrostatic head will be removed during the drilling operation.

Still further, as an advantage of the invention, lower pressures can be used for drilling, compared to drilling without abrasives. For instance, with the invention, pressures lower than about 4000 psi, and as low as 2000 to 3000 psi can be used.

BEST MODE FOR CARRYING OUT THE INVENTION

Figure 1:
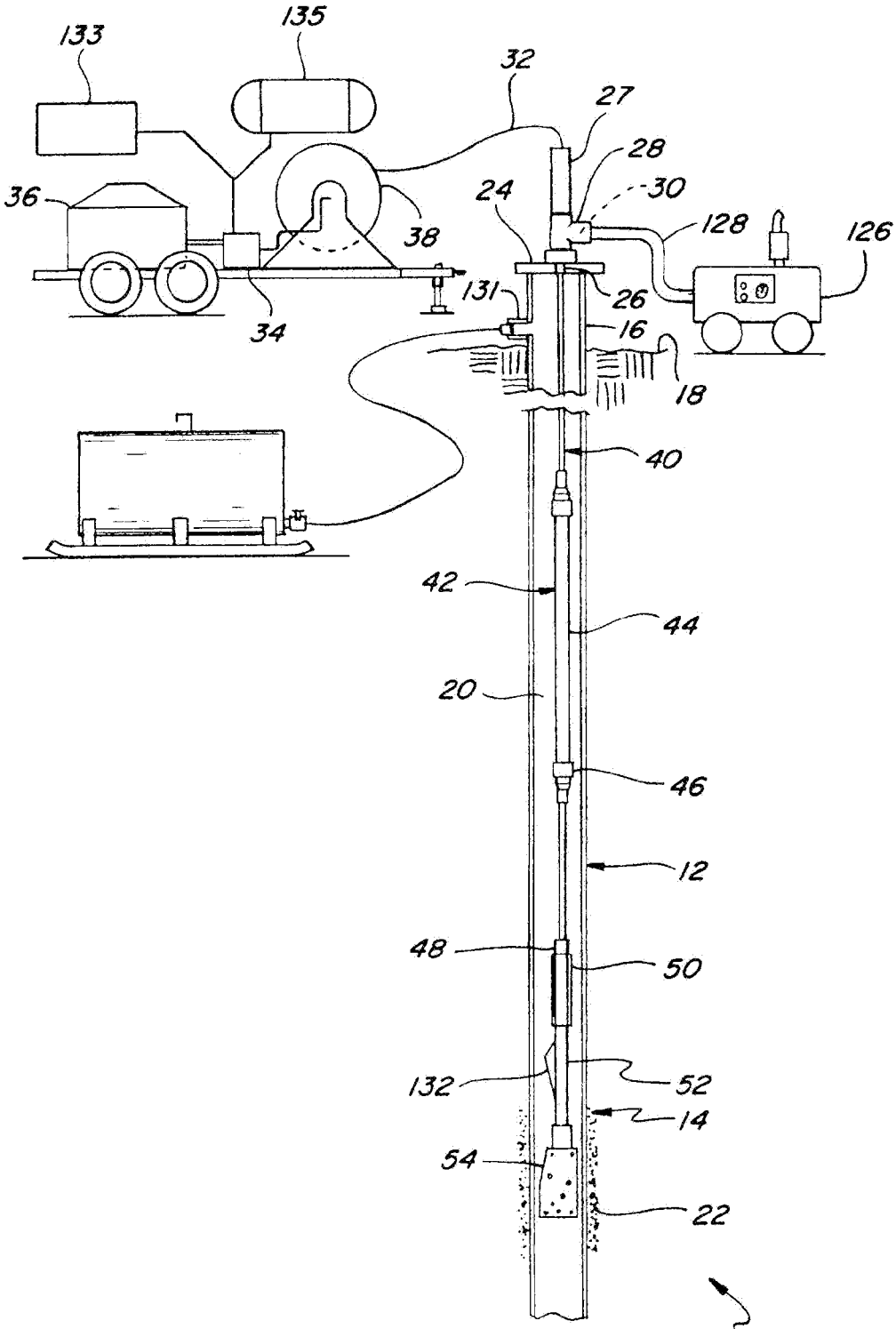
Fig. 1 PRIOR ART
FIG. 1 is a side elevational view showing a well in fragmentary cross section and apparatus according to the present invention therein in position for penetrating the well casing thereof.
Figure 2:
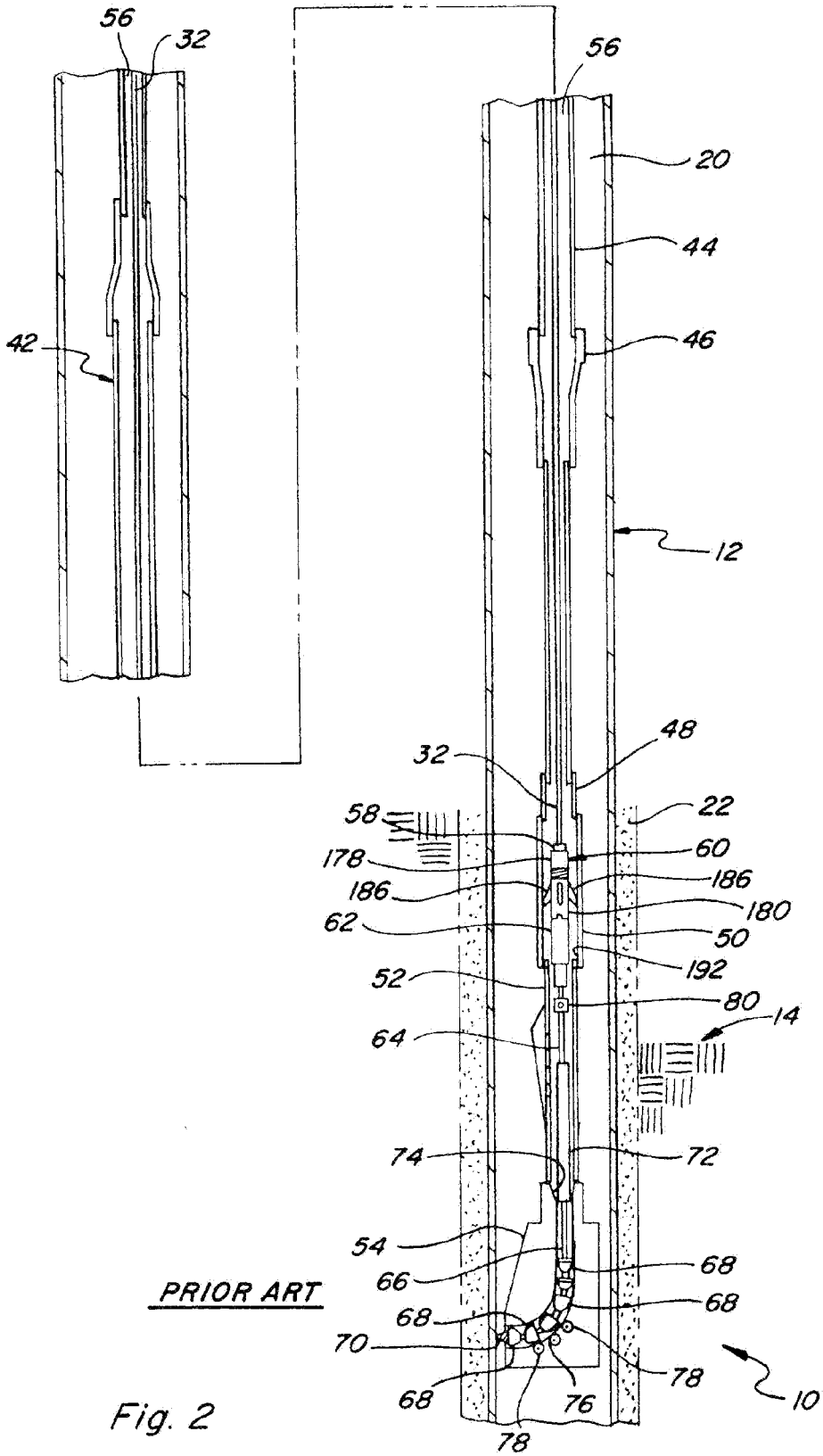
PRIOR ART Fig. 2
FIG. 2 is a side elevational view of the well and apparatus of FIG. 1 in partial cross-section showing the apparatus being used to form a hole through the casing.

FIGS. 1 and 2 show apparatus 10 constructed and operable according to the present invention for penetrating a well casing 12 and surrounding earth strata 14. Well casing 12 consists of steel piping extending from a well head 16 on or near the earth's surface 18 downwardly through strata 14 into a formation therein which hopefully contains oil and/or gas. Well casing 12 is of conventional construction defining an interior passage 20 of from between about 4 to about 8 inches in diameter and from several hundred to several thousand feet in depth. Cement or other material 22 is typically located around well casing 12 to hold it in place and prevent leakage from the well. Well head 16 includes a cap 24 having an opening 26 therethrough communicating passage 20 with a conventional oil saver device 27, and a tee 28 including an access port 30.

Apparatus 10 includes a quantity of flexible tubing 32 adapted for holding fluid under pressure sufficient for drilling the formation. For instance, pressure of as high as about 10,000 psi have been used for wells at depths of about 2000 feet from the surface, and higher pressures such as about 15,000 psi can be used for drilling at greater depths. The fluid under pressure is supplied by a pump 34 connected to a fluid source 36 such as a city water supply, a water tank or the like. Flexible tubing 32 is stored on a reel 38 from which the tubing is fed into a length of more rigid tubing 40 which extends a desired distance down through interior passage 20 of casing 12 to a desired elevation below the earth's surface. Tubing 40 terminates in passage 20 of casing 12 at a coupling with a down hole unit 42 suspended in passage 20 by tubing 40. Down hole unit 42 includes a tubular motor housing 44, an upper receiving tube 46 and a kick-off shoe unit 48. Kick-off shoe unit 48 includes a tubular casing drill receiving unit 50, an air jet tube 52 and a bottom-most kick-off shoe 54. Tubing 40 and down hole unit 42, including motor housing 44, upper receiving tube 46, and all of the above discussed components of kick-off shoe unit 48 remain in the position shown down hole in casing 12 throughout operation of apparatus 10.

Flexible tubing 32 extends through a cavity 56 extending through tubing 40 and down hole unit 42, and terminates at a coupler 58 shown supporting a casing drill unit 60 in FIG. 2. Casing drill unit 60 includes a fluid driven motor 62 connected in fluid communication with flexible tubing 32. Motor 62 is constructed essentially as shown in FIG. 9A, and in the configuration shown in FIG. 2, is connected to an output shaft 64 operatively rotatable thereby and including a terminal end 66 supporting a plurality of universal joints 68 for rotation therewith, including an end most universal joint 68 having a conical shaped casing cutter 70 mounted thereto for rotation therewith. A protective sheath 72 is also mounted about output shaft 64 and defines an inner cavity (not shown) for containing and protecting universal joints 68 and casing cutter 70 as those members are lowered through cavity 56 of tubing 40 and down hole unit 42. As casing drill unit 60 is lowered through cavity 56, sheath 72 will come into abutting relation with a beveled edge 74 within kick-off shoe 54 thus stopping downward travel of the sheath, while casing cutter 70 and universal joints 68 will proceed into shoe 54, travel around an elbow 76 therein, such that casing cutter 70 will come as shown to rest against the inner surface of casing 12. In this regard, shoe 54 includes a plurality of rollers 78 to facilitate travel of cutter 70 and universal joints 68 through elbow 76, and output shaft 64 includes a swivel 80 for alignment purposes.

Figures 2A, 2B:
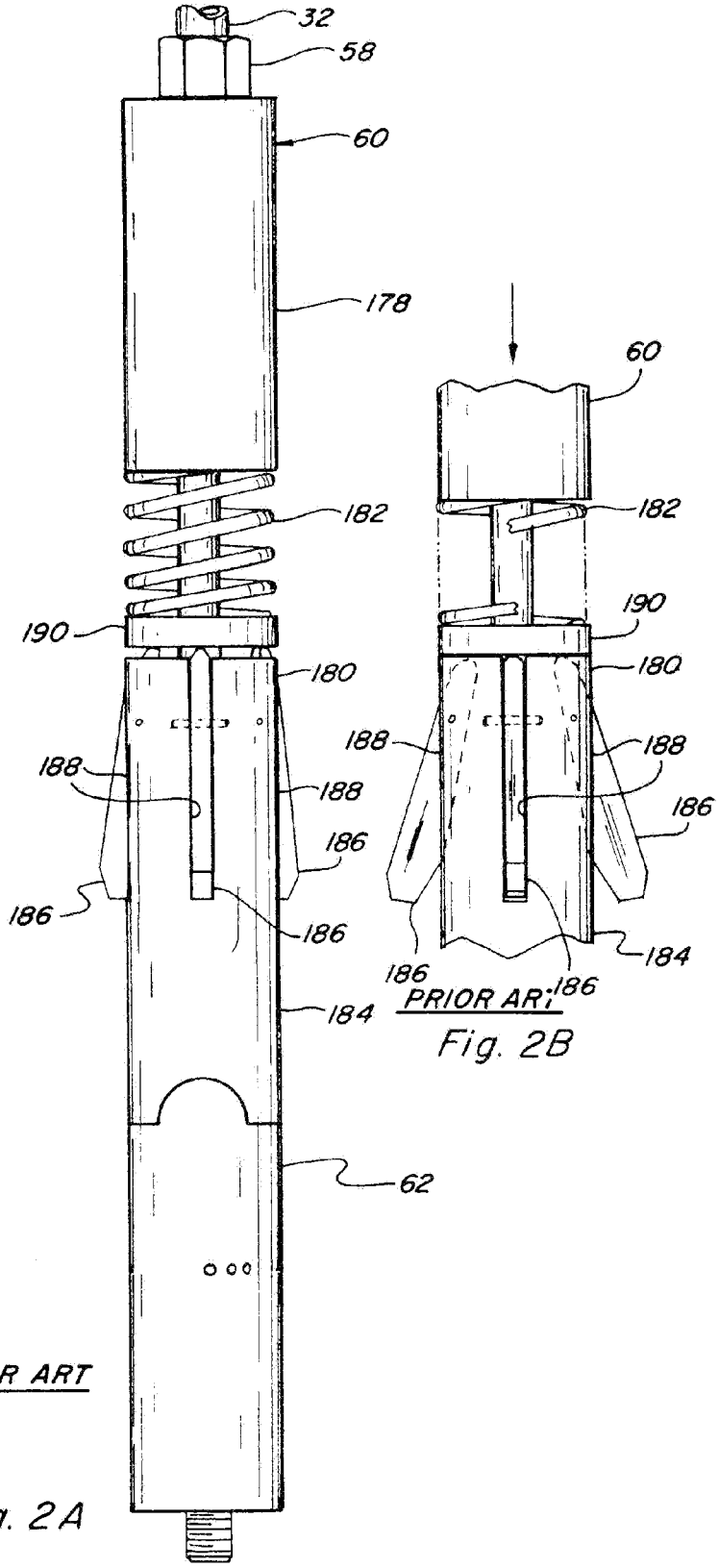
Fig. 2B PRIOR ART
FIG. 2A is a fragmentary enlarged fragmentary side view of the apparatus of FIG. 1.
FIG. 2B is another enlarged fragmentary side view of the apparatus of FIG. 1.

Also referring to FIGS. 2A and 2B, casing drill unit 60 additionally includes an upper portion 178 connected to flexible tubing 32 via coupler 58, and a spring loaded dog assembly 180 disposed between upper portion 178 and motor 62. Dog assembly 180 includes a compression coil spring 182 disposed between upper portion 178 and a dog housing 184 including a plurality of dogs 186 pivotally mounted in slots 188 at angularly spaced locations around housing 184. Dogs 186 are maintained in engagement with a spring retainer 190 by spring 182 in a retracted position (FIG. 2A) and are moveable in opposition to the spring to a radially extended position (FIG. 2B) when sheath 72 forcibly contacts beveled edge 74 of kick-off shoe 54 (FIG. 2). When radially extended, dogs 186 engage a splined inner circumferential surface 192 of casing drill receiving unit 50 for preventing rotating of casing drill unit 60 therein. Then, in one embodiment of a method of the invention, after the casing drilling operation is completed as explained next, and casing drill unit 60 is withdrawn from receiving unit 50, dogs 186 retract to allow passage upwardly through the upper portion of down hole unit 42 and tubing 40.

Figure 3:
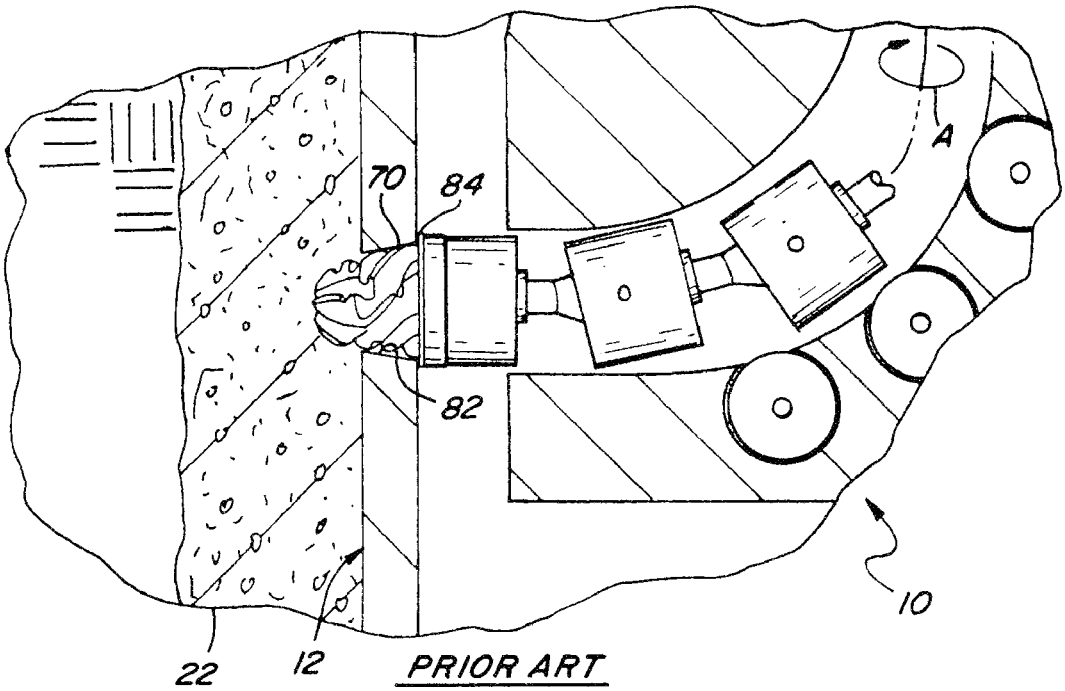
FIG. 3 is an enlarged fragmentary sectional view of the well and apparatus of FIG. 1 showing the completed hole through the casing.

Referring also to FIG. 3, in one method of the invention, rotation of casing cutter 70 of apparatus 10 as shown by arrow A, by motor 62 while urged against the inner surface of casing 12 results in casing cutter 70 cutting through casing 12, producing a hole 82. Importantly, an annular drill stop 84 extends around casing cutter 70 at a predetermined location spaced from the tip thereof to prevent casing cutter 70 from cutting substantially past casing 12 into cement 22. Upon formation of hole 82, operation with casing drill unit 60 is complete, and that unit can be withdrawn from down hole unit 42 and tubing 40.

Figure 3A:
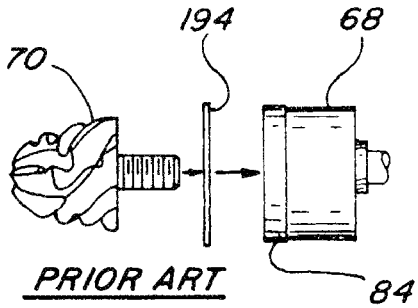
FIG. 3A is an exploded side view of a cutter of the apparatus of FIG. 1.

Referring to FIG. 3A, a consumable shim 194 is disposed between cutter 70 and drill stop 84 which is mounted to endmost universal joint 68. Shim 194 is damaged by rotating contact with the inner surface of casing 12 and importantly can be inspected after withdrawal of unit 60 from casing 12 for verify that hole 82 has been properly formed.

Figure 4:
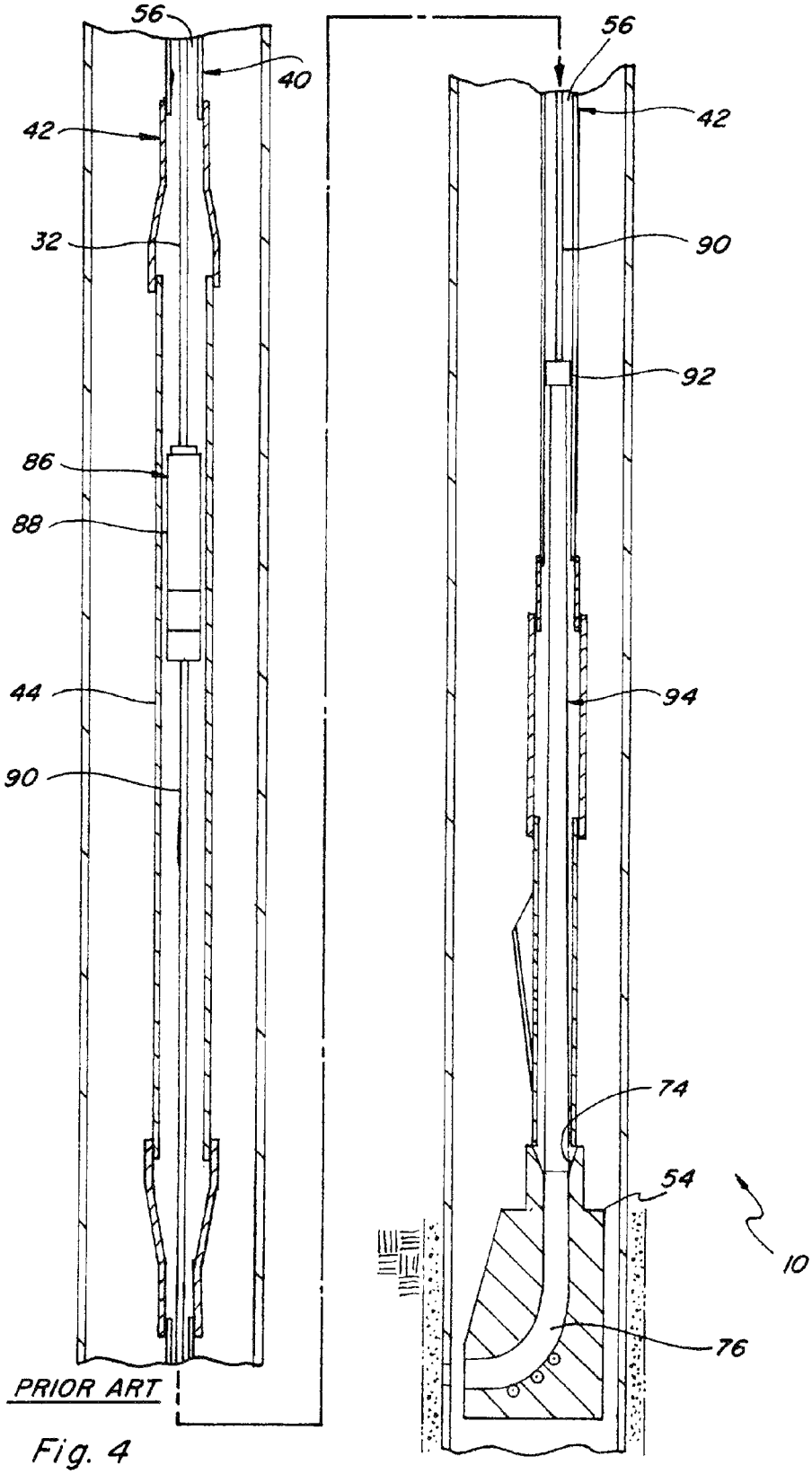
FIG. 4 is a fragmentary side elevational view in section showing apparatus according to the present invention for drilling strata surrounding the well casing.

Referring to FIG. 4, in this method of the invention, after withdrawal of casing drill unit 60, a strata drill unit 86 of apparatus 10 is mounted to flexible tubing 32 and lowered through cavity 56 of tubing 40 and down hole unit 42 to kick-off shoe 54. Strata drill unit 86 includes a fluid driven motor 88 located in motor housing 44, motor housing 44 having an inside cross-sectional shape at least marginally larger than the outer cross-sectional shape of motor 88, as will be discussed. A rigid tube 90 is connected to motor 88 for rotation thereby. Rigid tube 90 terminates at an upper end 92 of a set down device 94.

Figure 5:
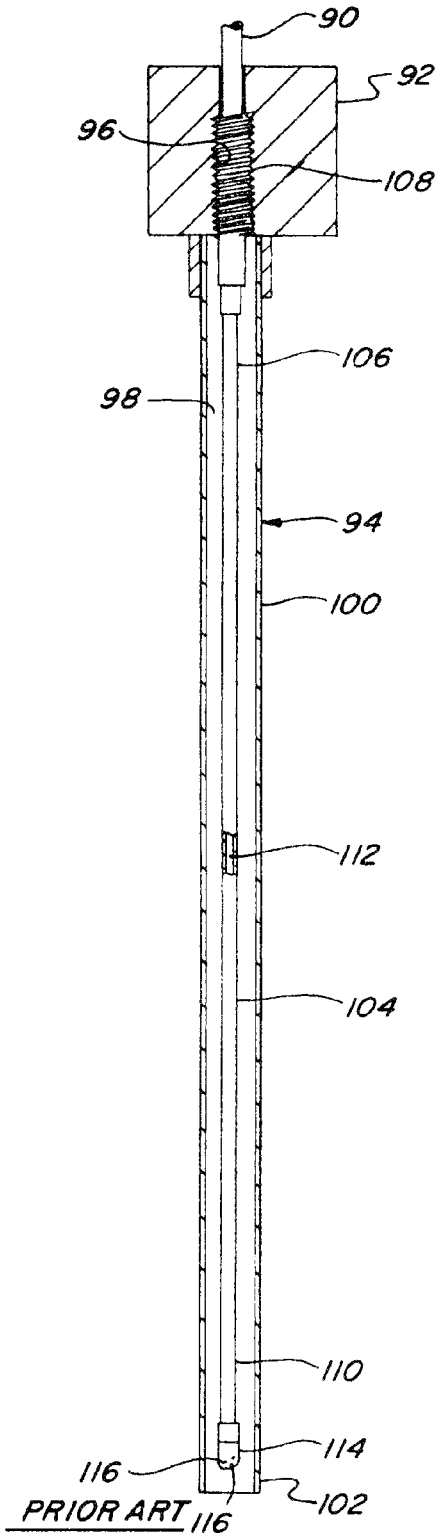
FIG. 5 is a fragmentary side view in partial cross-section of the apparatus of FIG. 4.
Figure 5A:
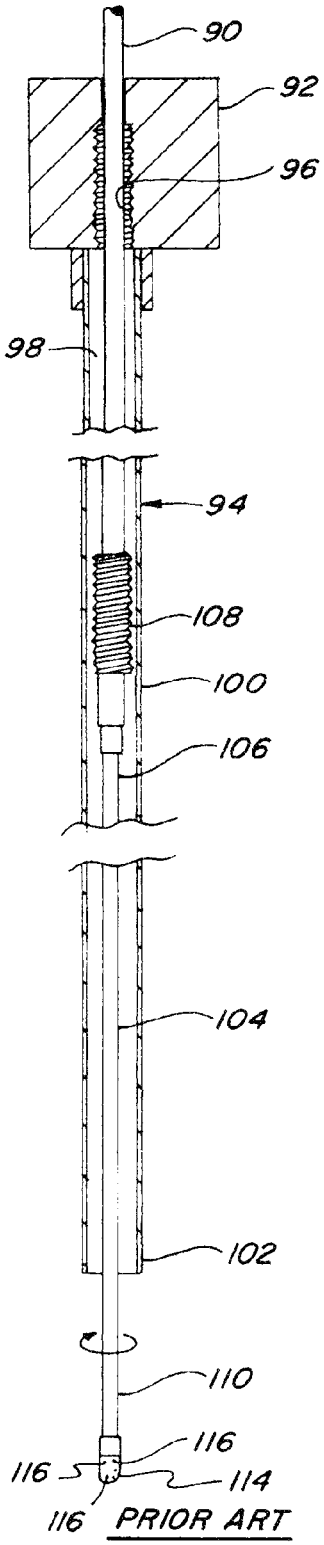
FIG. 5A is a fragmentary side view of the apparatus of FIG. 4 in an extended position.

Referring also to FIGS. 5 and 5A, set down device 94 includes a threaded passage 96 extending therethrough and communicating with an internal passage 98 of a rigid tubular sheath 100. Sheath 100 includes a bottom most terminal end 102 positionable in abutment with beveled edge 74 of kick-off shoe 54 for positioning internal passage 98 in communication with elbow 76 (FIG. 4). A flexible tube 104 has an upper end 106 mounted to rigid tube 90 for rotation therewith by an externally threaded coupler 108 adapted for threaded engagement with set down device 94 in threaded passage 96. When coupler 108 is threadedly engaged with set down device 94, flexible tube 104 is located and protected within internal passage 98 of sheath 100. Flexible tube 104 includes a lower end 110 opposite upper end 106, and an internal passage 112 therethrough connecting upper end 106 with lower end 110. A nozzle 114 is mounted to lower end 110 of tube 104 in fluid communication with internal passage 112. Nozzle 114 includes a plurality of apertures 116 therethrough. Referring more particularly to FIGS. 4, 5 and 5A, motor 88 is operable to rotate rigid tube 90 to threadedly disengage coupler 108 from threaded passage 96 of set down device 94 to allow nozzle 114 and lower end 110 of flexible tube 104 to drop beneath sheath 100, for entering elbow 76 of shoe 54.

Figure 6:
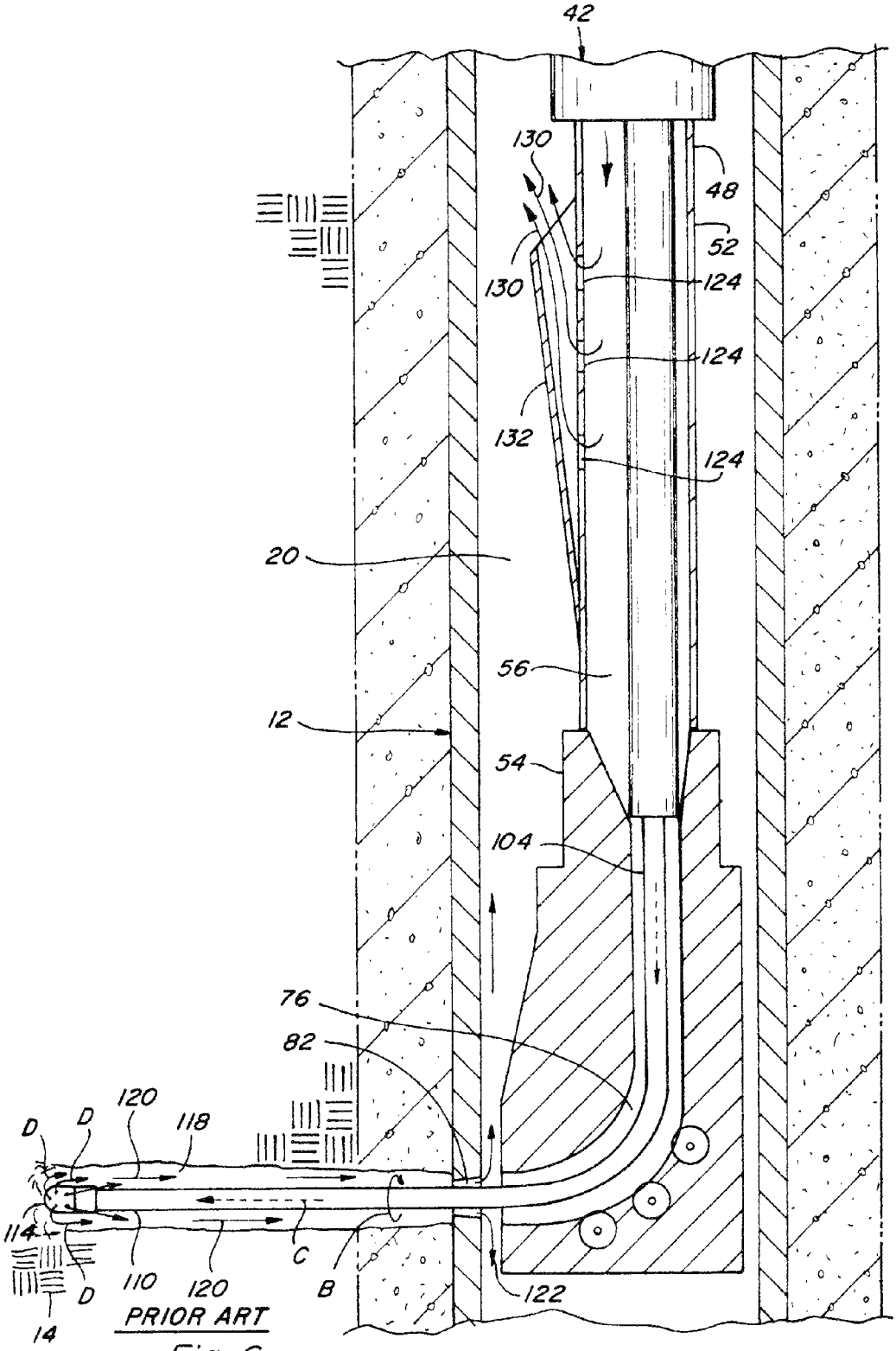
PRIOR ART Fig. 6
FIG. 6 is a fragmentary side elevational view of the apparatus of FIG. 4 drilling an extension of the hole of FIG. 2 into the strata and reducing a hydrostatic head over the hole.

Turning to FIG. 6 as flexible tube 104 is continually lowered, lower end 110 and nozzle 114 will pass through elbow 76 of shoe 54 and into hole 82 through casing 12, hole 82 having a slightly tapered shape corresponding to the shape of casing cutter 70. As nozzle 114 advances through hole 82, it is rotated as denoted by the arrow B by motor 88 (FIG. 4) and fluid from fluid source 36 is pressurized by pump 34 (FIG. 1) and communicated to nozzle 114 through motor 88, rigid tube 90 (FIG. 4), and flexible tube 104, as denoted by the arrow C. The fluid under pressure is discharged from nozzle 114 through apertures 116 against cement and strata 14 lying beyond hole 82, as denoted by the arrows D. The fluid under pressure impinging the cement and/or strata 14, in combination with the rotation of nozzle 114, operates to loosen and dislodge particles to thereby drill an extension 118 of hole 82 into the cement and/or strata 14. Additionally, a fluid flow as shown by the arrows 120 is created by the discharged fluid for carrying the particles through extension 118 and hole 82 so as to be discharged into interior passage 20 of casing 12 as denoted by arrow 122.

During the strata drilling step, it has been found that if a hydrostatic head having a pressure greater than the formation pressure in extension 118 is present above the drilling location, for instance, resultant from the addition of water or liquid from the strata drilling operation to the column of liquid normally present in casing 12, liquid will be absorbed into the formation or strata around nozzle 114 and flexible tube 104, so as to stop the fluid and particle flow denoted by arrows 120. For instance, it has been found when attempting to drill an extension 118 at a depth of about 2500 feet below the earth's surface and with a hydrostatic head which has greater head pressure than the formation pressure, little to no drilling progress could be made, which is believed largely due to limitations on particle and fluid flow 120 caused by the hydrostatic head.

To mitigate the above discussed problems relating to a large hydrostatic head, air jet tube 52 has a plurality of air jets 124 communicating internal passage 56 extending through tubing 40 and down hole unit 42 with interior passage 20 of casing 12. Referring back to FIG. 1, a compressor 126 is located on surface 18 and includes a high pressure line 128 connected through access port 30 with internal passage 56. Compressor 126 is conventionally operable to compress air and direct the air through high pressure line 128 into internal passage 56 wherein the pressurized air travels downwardly to air jets 124 and is discharged into interior passage 20 as denoted by the arrows 130. Here, it should be noted that compressor 126, line 128, tubing 40 and the components of down hole unit 42 should be constructed so as to be sufficiently strong to withstand the pressures necessary for carrying air under pressure to the contemplated depth and discharging the air through air jets 124. An important purpose for discharging air under pressure into interior passage 20 is to use the air as a vehicle for transporting water and other liquids in interior passage 20 upwardly through the passage so as to be discharged through an access port 131 at the earth surface 18, or through some other convenient port at the surface, to effectively reduce any hydrostatic head that may be present. Further in this regard, air jet tube 52 includes a venturi hood 132 over jets 124 designed for directing air discharged from the jets upwardly so as to provide a venturi like effect.

Here, it should be noted that periodically during the strata drilling step, air or gas under pressure can be injected into flexible tubing 32 so as to be discharged through apertures 116 of nozzle 114, for clearing any debris or blockage that may be present therein and for clearing accumulated debris from extension 118. A suitable pressure for the air or gas has been found to be about 2,000 psi or greater, and it can be injected by a high pressure compressor 133 or other suitable device connected to tubing 32 at pumps 34 as shown or at another suitable location. This is believed to be effective because with the reduction of the hydrostatic head in the well, when the air or gas under pressure exits apertures 116 the air or gas will expand and move at high velocity toward casing 12 to urge the cuttings from extension 118.

Figure 7:
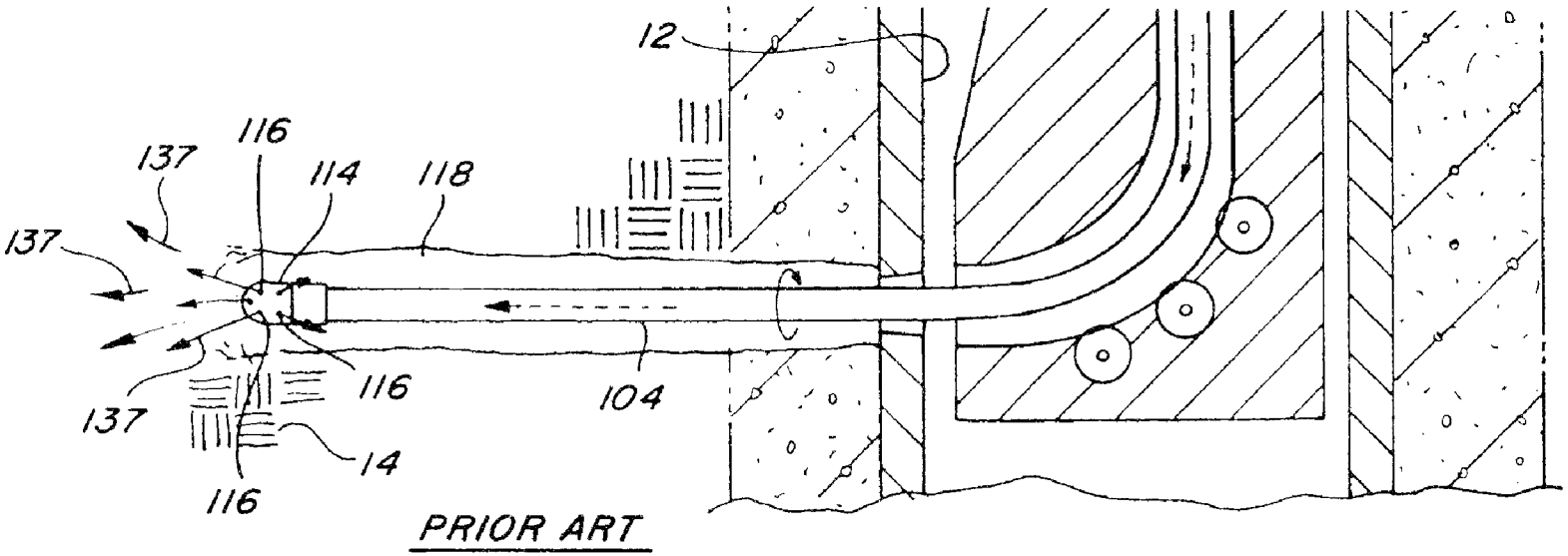
PRIOR ART Fig. 7
FIG. 7 is a fragmentary side elevational view of the apparatus of FIG. 4 showing an acid or a gas being injected into the extension of FIG. 6.

Referring to FIGS. 1 and 7, after extension 118 has been drilled to a desired extent, the delivery of air to air jets 124 can be stopped, to allow the hydrostatic head to again build up. Then, once the hydrostatic head is sufficiently high, an acid, mixture of acid and another substance, or a gas contained in a tank 135 on the earth's surface 18 can be injected into flexible tubing 32 under pressure supplied by compressor 133, pump 34 or another suitable device, so as to be conveyed through flexible tube 104 to nozzle 114 and discharged through apertures 116 thereof into strata 14 surrounding extension 118. This has been found to be an advantageous procedure, as the acid, mixture or gas is delivered in a pristine condition to the strata surrounding extension 118, for etching or otherwise reacting with alkaline materials in the strata, for increasing the production potential at that location. Here, the presence of the hydrostatic head has been found to provide a pressurized condition in well casing 12 which is sufficient to maintain the acid or gas localized within extension 118 where it is desired.

Figure 8:
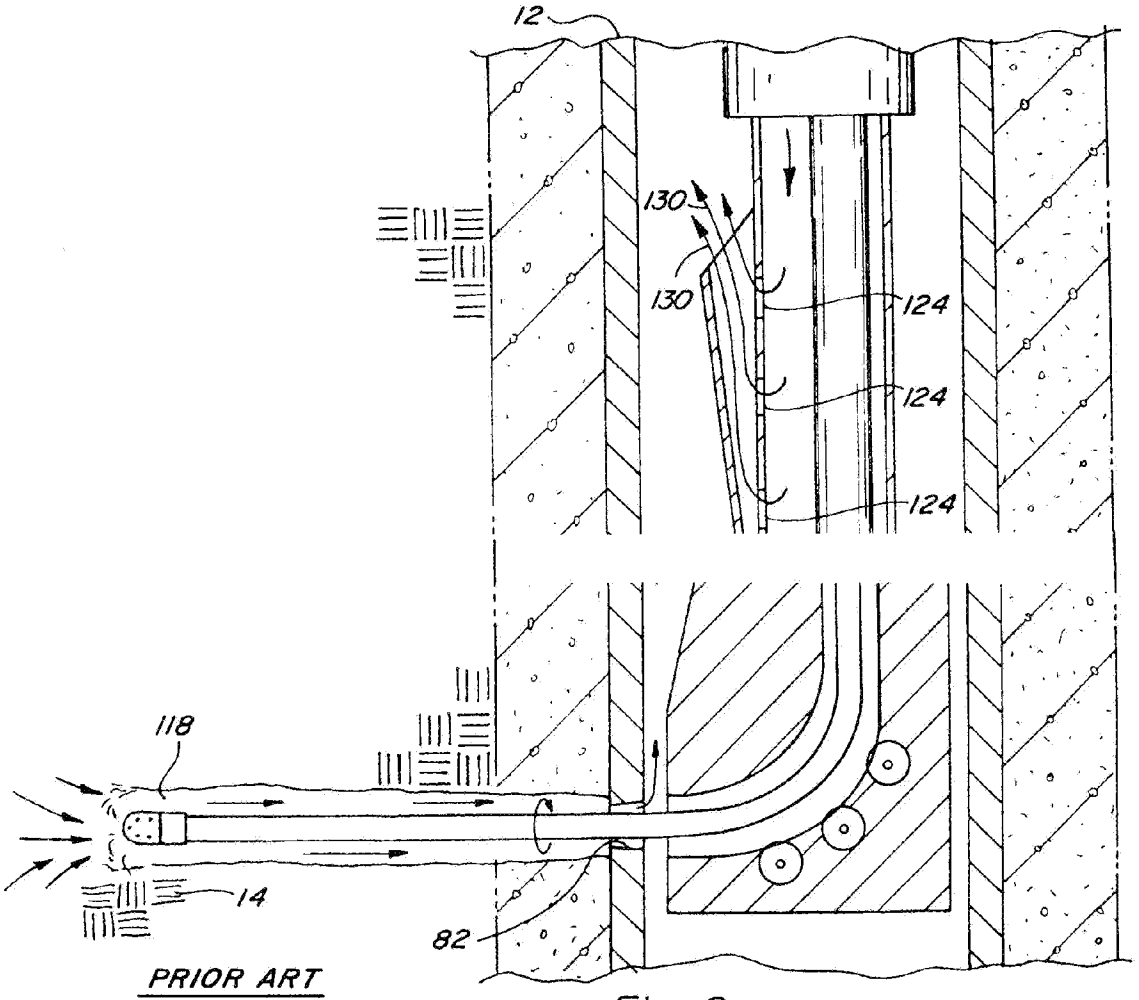
Fig. 8 PRIOR ART
FIG. 8 is a fragmentary side elevational view of the apparatus of FIG. 4 showing flow of material from the extension during reduction of the hydrostatic head.

Referring also to FIG. 8, after a sufficient period of time for the acid or gas to perform its desired function has elapsed, the hydrostatic head can be reduced by pumping air through air jets 124 in the above-described manner as denoted by the arrows 130 to reduce the hydrostatic head, such that the acid, gas and/or reaction products can flow from the strata 14 in the vicinity of extension 118, through hole 82 and into casing 12, wherein those materials can be carried by the pressurized air to well head 16. At well head 16 the material can exit casing 12 through access port 131 and be collected in a suitable repository, such as the storage tank illustrated. There, the material can be examined to ascertain the success of the acid or gas injection to determine whether drilling and/or injection should be continued.

As noted above, it is important to rotate nozzle 114 during the strata drilling step such that extension 118 is of sufficient size and is unobstructed to allow the advancement of nozzle 114 and flexible tube 104 therethrough. Rotation of flexible tube 104 and nozzle 114 is preferably achieved using motor 88.

Figure 9:
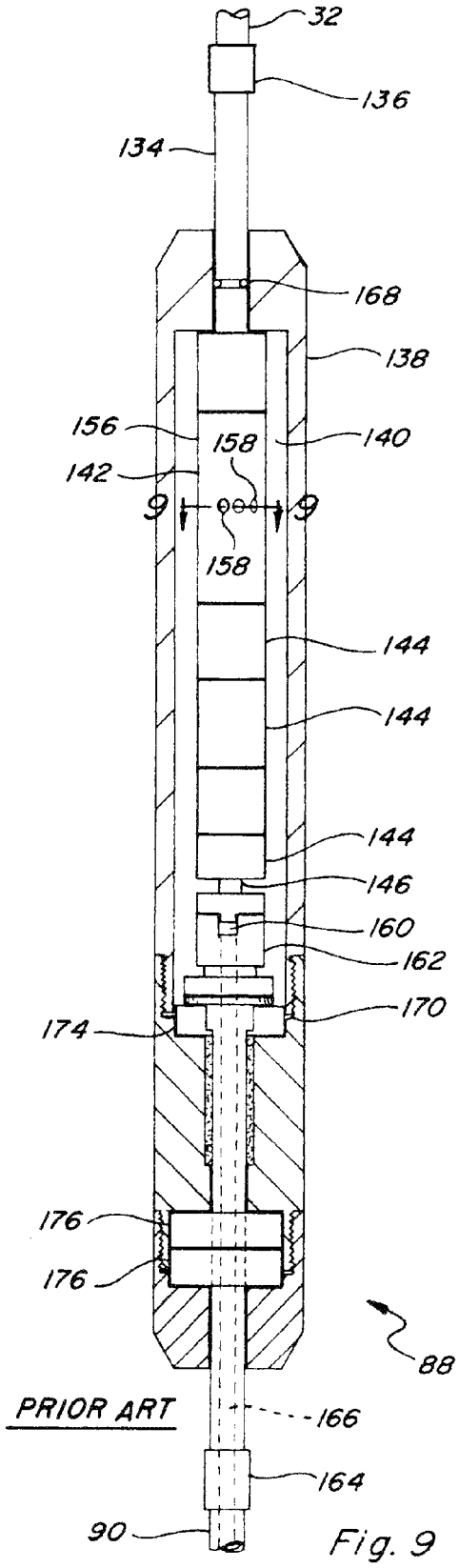
FIG. 9 is a side elevational view of the apparatus of FIG. 4 in partial cross-section.
Figure 9A:
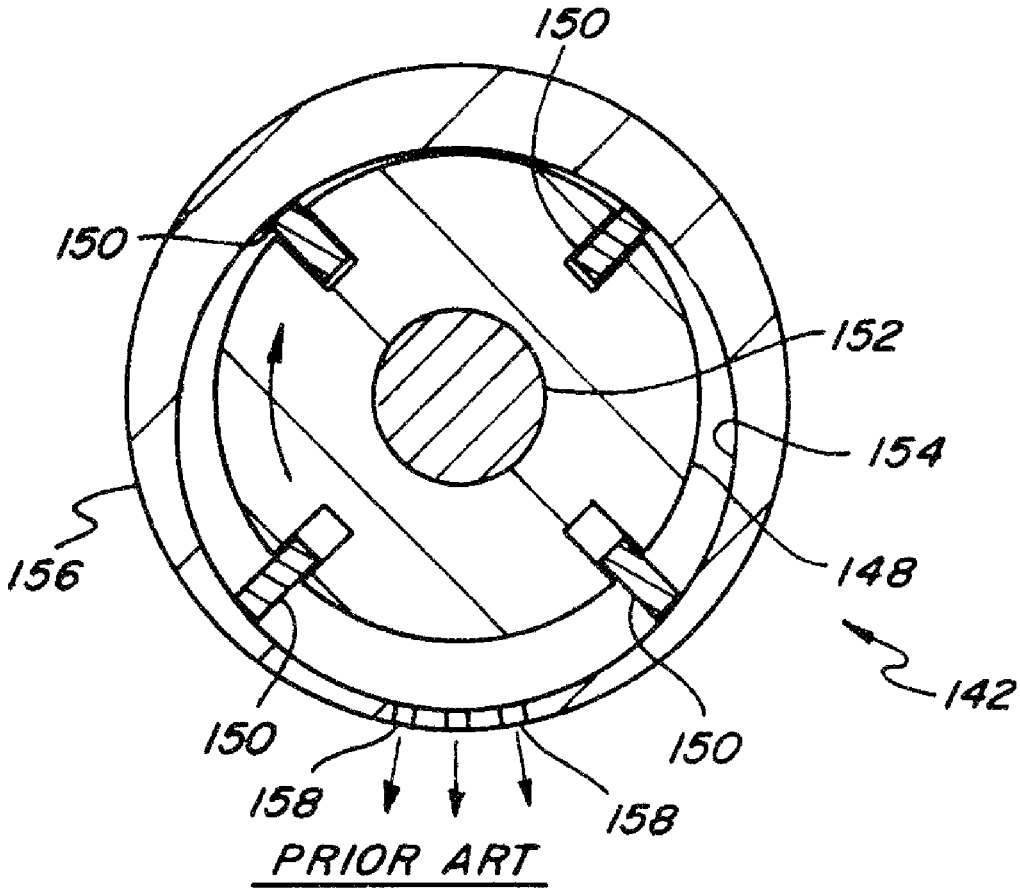
FIG. 9A is a cross-sectional view taken along line 9-9 of FIG. 9.
Figure 10:
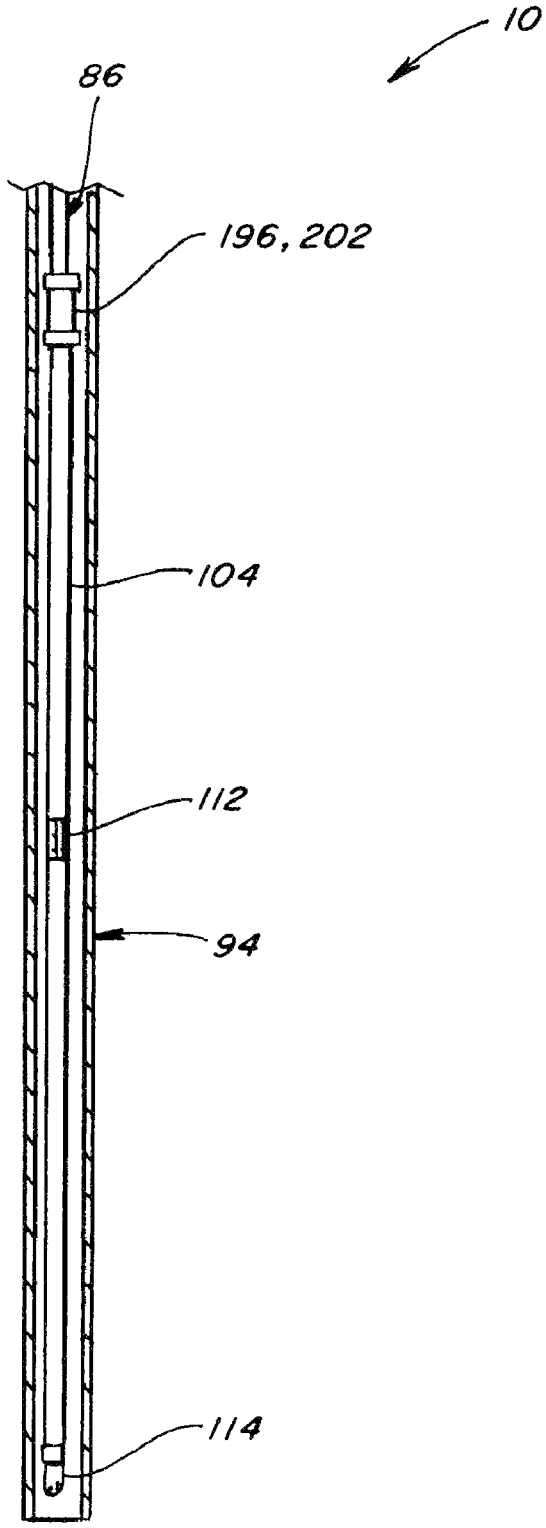
FIG. 10 is another fragmentary side view in partial cross-section of the apparatus of FIG. 4, including apparatus of the invention for introducing abrasives into fluid flow to a nozzle of the apparatus.
Figure 11:
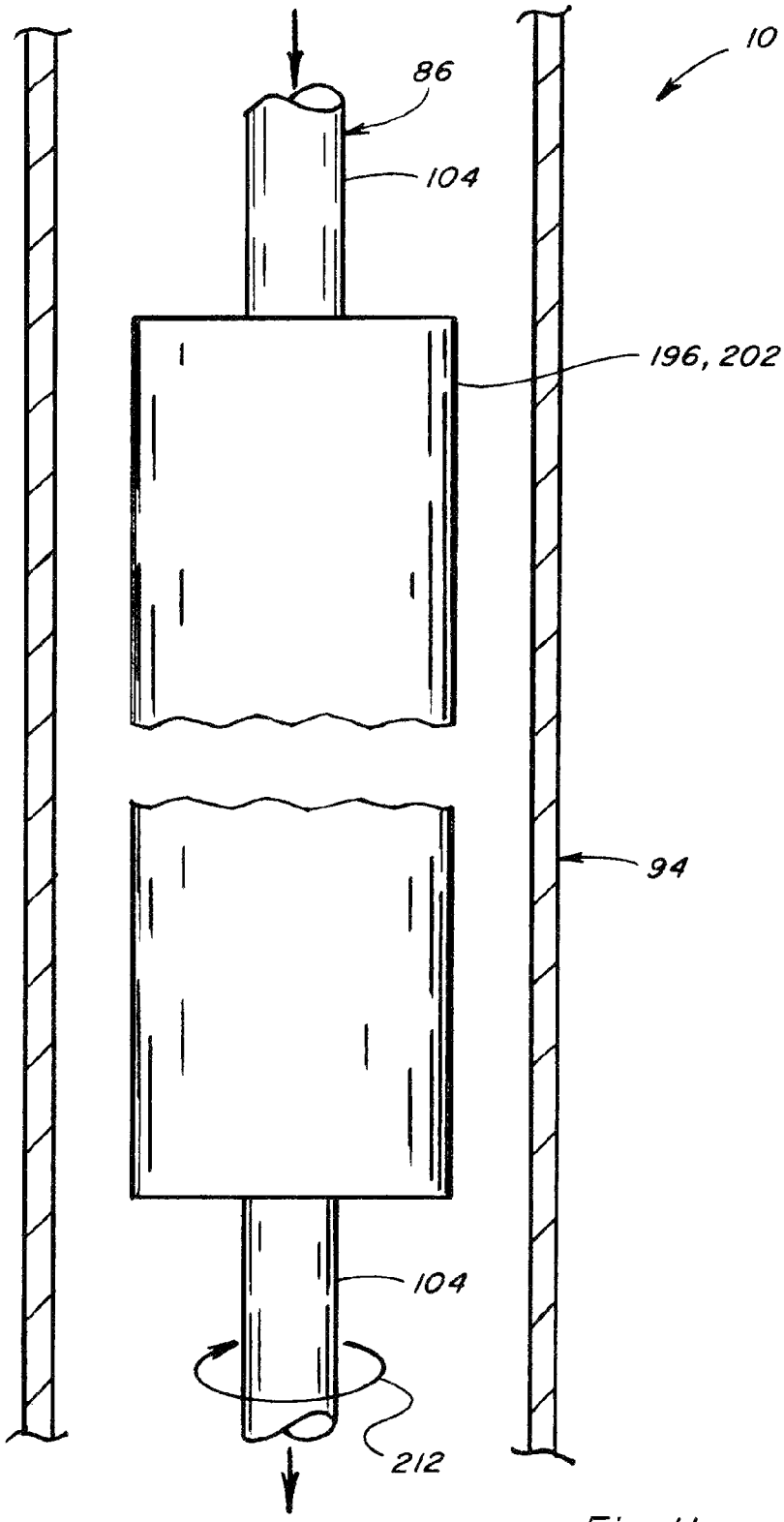
FIG. 11 is an enlarged fragmentary side view of the apparatus of FIG. 10.
Figure 12:
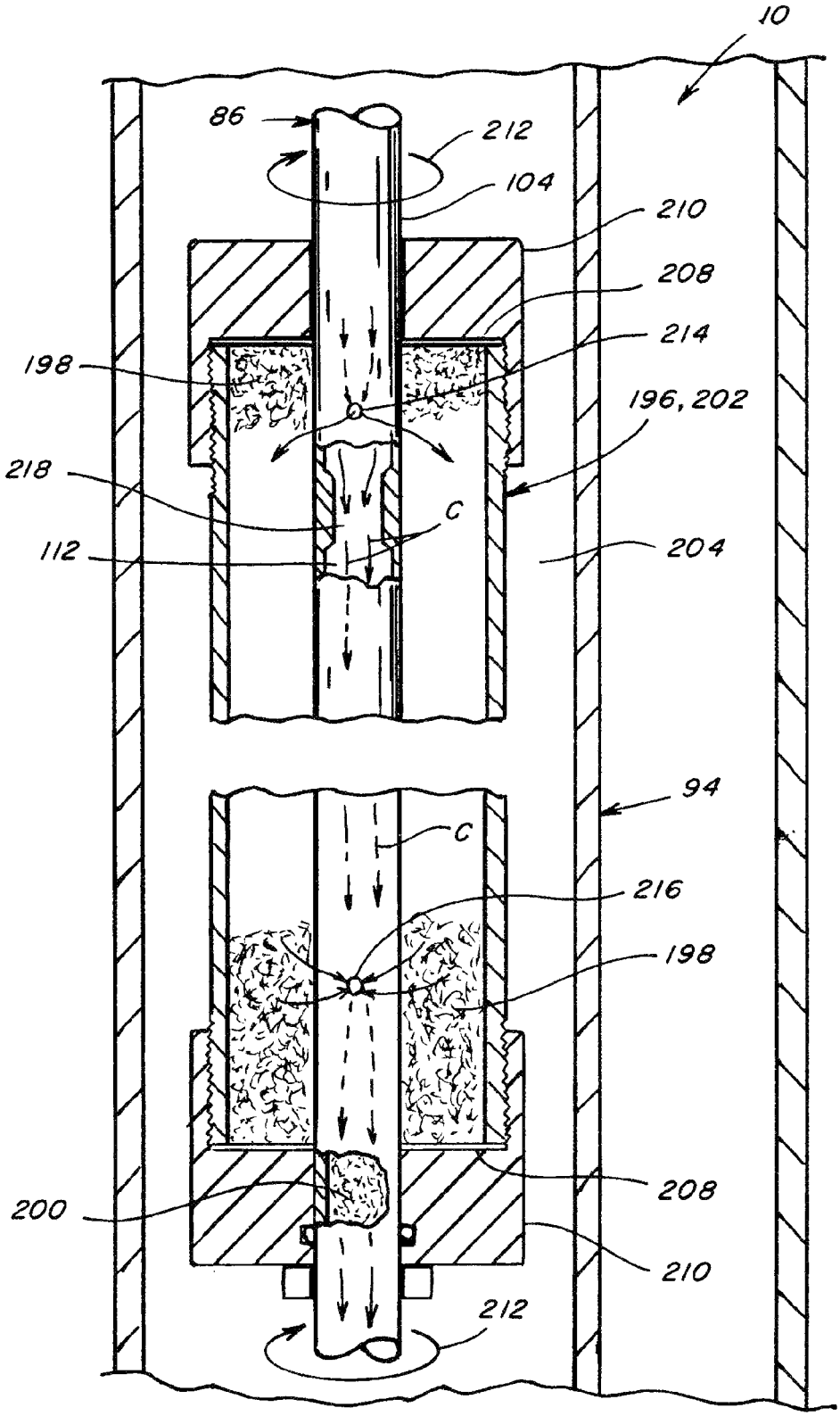
FIG. 12 is another enlarged fragmentary side view of the apparatus of FIG. 10, in partial cross-section to show internal aspects thereof.

Turning to FIG. 9, motor 88 is shown. Motor 88 includes an inlet nipple 134 coupled in fluid communication with tubing 32 by a coupler 136 for receiving pressurized fluid from pump 34 therethrough. Coupler 136 also supports motor 88, rigid tube 90, flexible tube 104 and nozzle 114. Motor 88 includes an outer case 138 defining an internal cavity 140 containing a fluid motor unit 142 connected in driving relation to a plurality of gear reducers 144, including a final gear reducer having an output shaft 146 driven by fluid motor unit 142. Referring also to FIG. 9A, fluid motor unit 142 is a vane type fluid motor having an eccentric 148 including a plurality of radially moveable vanes 150 of solid brass, copper or other substantially rigid material. Motor 62 discussed above is constructed essentially the same. Motor unit 142 is connected in driving relation to a drive shaft 152 for relative eccentric rotation to an inner circumferential surface 154 of an inner case 156 under force of pressurized fluid received through inlet nipple 134. The fluid is then discharged from inner case 156 through discharge ports 158 into internal cavity 140 wherein the pressurized fluid travels to an inlet port 160 of a hollow motor output shaft 162. Output shaft 162 passes through outer case 138 and is coupled to rigid tube 90 by a coupler 164. Output shaft 162 includes an internal passage 166 thus connected in fluid communication with internal passage 112 through tube 90 and tube 104, for delivering the pressurized fluid to nozzle 114.

As noted above, the pressurized fluid carried through tubing 32 to motor 88 can be at a pressure of as high 10,000 psi or greater. To enable motor assembly 88 to withstand and contain such pressures without significant leaking, an O-ring 168 is located around inlet nipple 134, a second O-ring 170 extends around the juncture of two parts of outer case 138, and a series of O-rings or packing 172 extend around motor output shaft 162 as it passes through case 138. Additionally, a thrust bearing 174 and ball bearings 176 are provided in association with output shaft 162 for the smooth rotation of tubes 90 and 104, and nozzle 114.

Referring also to FIGS. 10, 11, 12 and 13, apparatus 10 of the invention can be alternatively configured so as to be capable of introducing abrasives into the fluid stream discharged from nozzle 114 during the drilling operation. This is advantageous as it enhances the drilling capability, including to drill through harder formations and cement surrounding the well casing, and also optionally for drilling through the casing itself, so as to eliminate the necessity of separate casing drilling apparatus, e.g., drill unit 60 and casing cutter 70 discussed above. In a preferred embodiment of the invention, strata drilling unit 86 is configured to include an abrasives addition unit 196 in connection or cooperation with flexible tube 104, below or downstream of motor assembly 88 (FIG. 4), for introducing abrasives, such as, but not limited to, abrasive particles of sand, Garnets, and/or the like, denoted by number 198 in FIG. 12, into the fluid flow through internal passage 112, as denoted at 200, for discharge with the flow through the openings of nozzle 114, e.g., as shown in FIGS. 6, 7 (for cutting or drilling a formation) and FIG. 13 (for drilling a casing). Here, it should be noted that abrasives addition unit 196 can be utilized in cooperation with set down device 94 discussed hereinabove, but is not limited for use with that device.

Abrasives addition unit and 96 preferably includes a container 202 having an internal cavity 204 containing abrasives 198. Container 202 can be suitably supported in connection with tube 104, at a desired location below or downstream of motor assembly 88. For instance, a shoulder washer 206 can be soldered, swaged, or otherwise fixedly connected to tube 104 at the appropriate location, for supporting container 202 about tube 104. Container 202 can be fixed to tube 104, so as to be rotatable therewith, as denoted by arrows 212, or so as to allow rotation of tube 104 relative to or within the container, as desired. Container 202 can be of cylindrical or other desired shape, and can include one or more openings 208 enclosed by a suitable cover structure, such as an end cap 210, threadedly or otherwise engaged with container 202, to allow accessing internal cavity 204. Here, tube 104 extends through container 202, although it should be recognized that other constructions that provide communication between internal cavity 204 of container 202 and internal passage 112 of tube 104, can be utilized. Tube 104 includes a first orifice 214 connecting upper regions of internal passage 112 and internal cavity 204, to allow entry of the pressurized fluid from tube 104 into internal cavity 204. Tube 104 includes a second orifice 216 downstream of first orifice 214, connecting lower regions of internal passage 112 and internal cavity 204, to allow entry of abrasives 198 into internal passage 112 from internal cavity 204. And, tube 104 includes an internal restricted orifice 218 between first and second orifices 214 and 216. Restricted orifice 218 provides a pressure drop from first orifice 214 to second orifice 216, to facilitate flow of abrasives 198 from internal cavity 204 of container 202, into internal passage 112 of tube 104. Essentially in this regard, it is desired to provide a means for directing a desired flow of abrasives 198 into the fluid flow through internal passage 112, which is provided in a preferred embodiment by the pressure reduction achieved using restricted orifice 218, although it is recognized that other structures may provide this capability.

Figure 13:
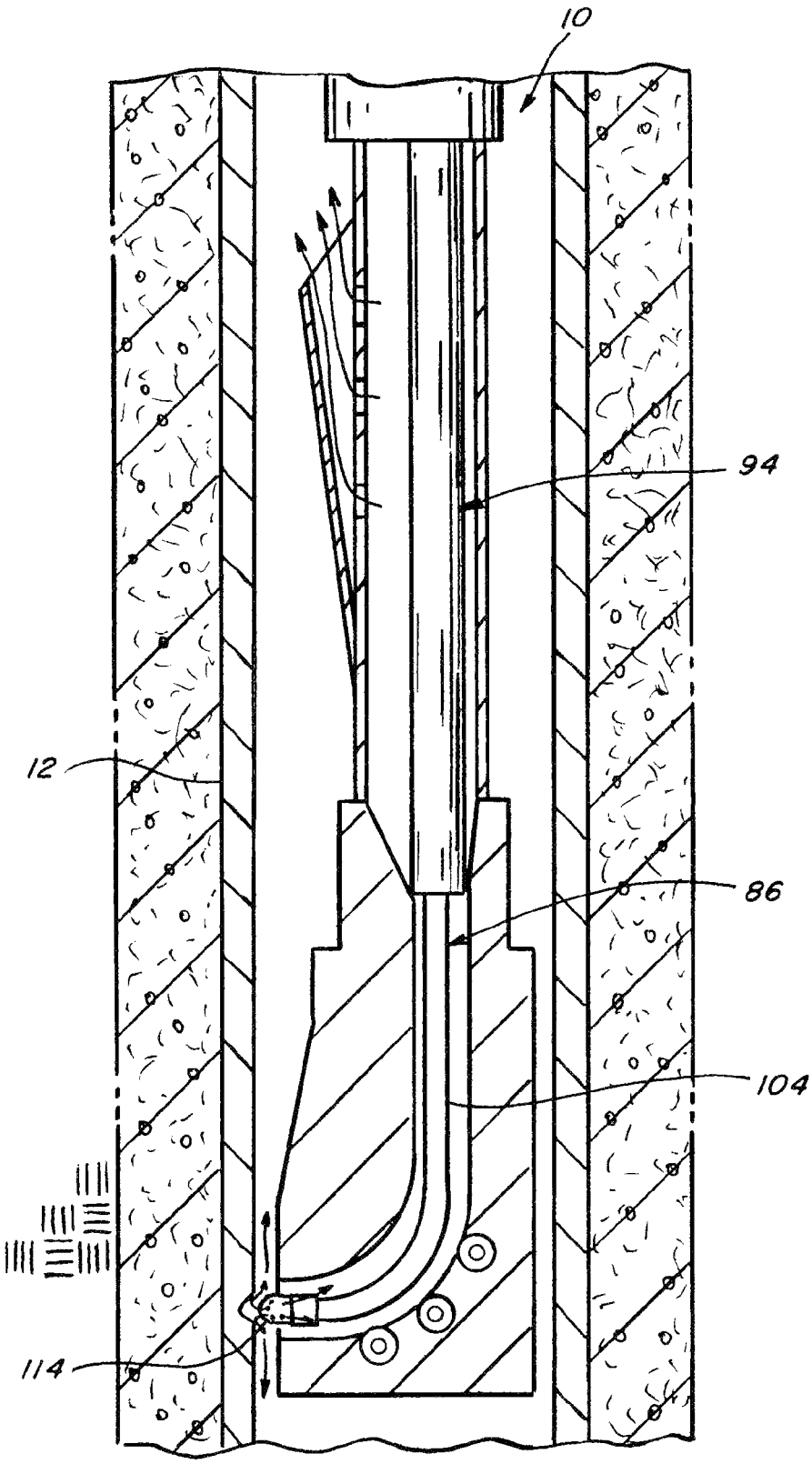
FIG. 13 is still another enlarged fragmentary side view of the apparatus of the invention, below the apparatus of FIG. 10, illustrating the apparatus drilling through a well casing.

Referring more particularly to FIGS. 6, 7 and 13, the mixture of fluid and abrasives 198 will exit tube 104 through the openings of nozzle 114, so as to impinge an adjacent surface in the path of the nozzle, which can be earth strata 14 (FIGS. 6 and 7), or a well casing 12 (FIG. 13), so as to drill a hole therein or therethrough.

At times, it may be desirable to prevent or limit flow of abrasives 198 into tube 104, such as when not actively drilling, or when lowering the tube into a well, or raising the tube. As one reason, loose abrasives 198 may fall to nozzle 114, so as to partially or fully clog or restrict it or a portion of the tube. Because of size constraints, and location (within a well) it is additionally desirable to have the capability of limiting or preventing flow automatically, and only allowing the flow when pressurized fluid is present in tube 104.

Figure 14:
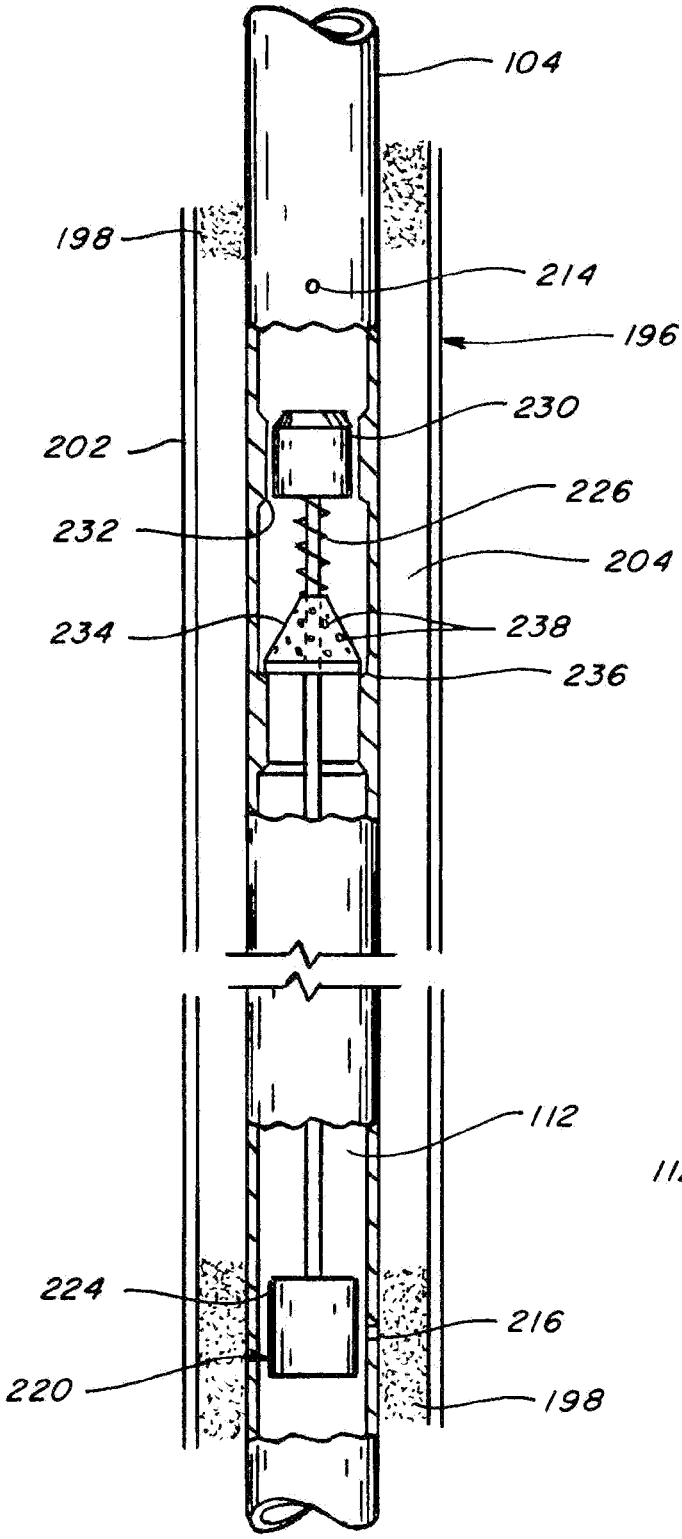
FIG. 14 is another enlarged fragmentary side view of the apparatus of the invention in cross section, illustrating optional closure apparatus in a closed mode for limiting abrasives flow.
Figure 15:
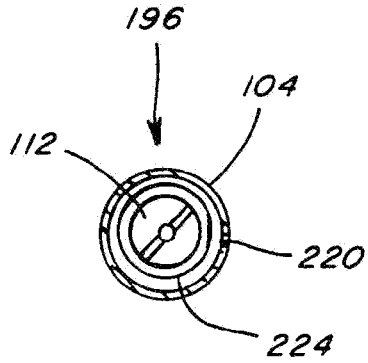
FIG. 15 is an enlarged cross sectional end view of the apparatus of FIG. 14.
Figure 16:
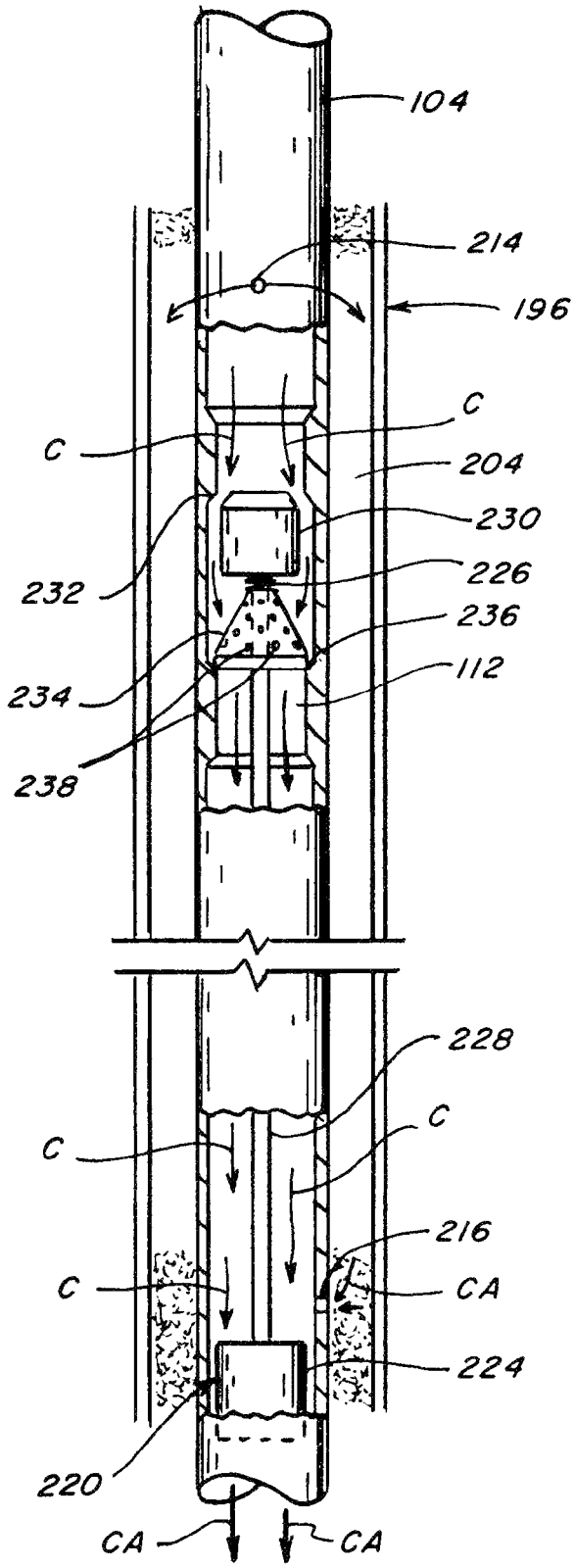
FIG. 16 is another enlarged fragmentary side view of the apparatus of FIG. 14 in cross section, illustrating the closure apparatus in an open mode.
Figure 18:
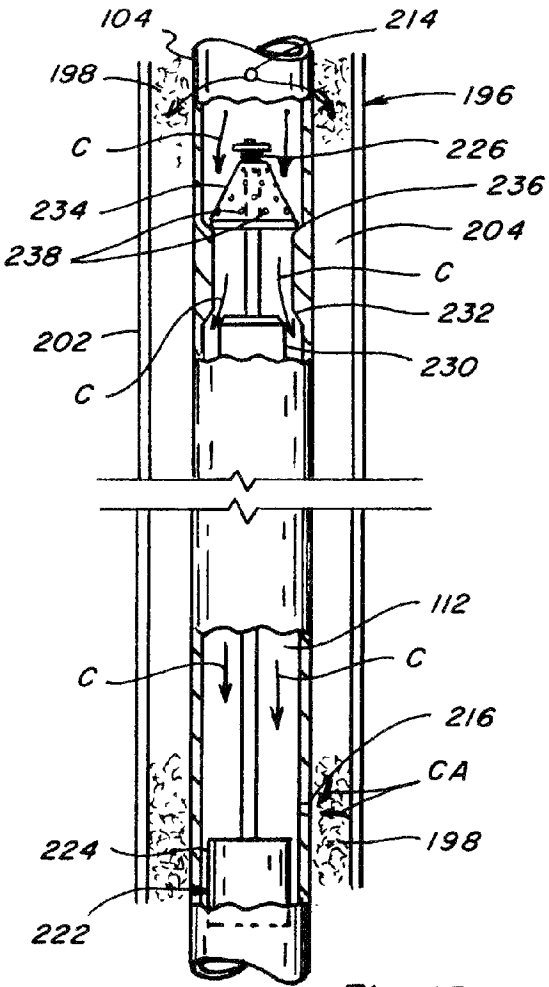
FIG. 18 is still another enlarged fragmentary side view of the apparatus of FIG. 17 in an open mode.
Figure 17:
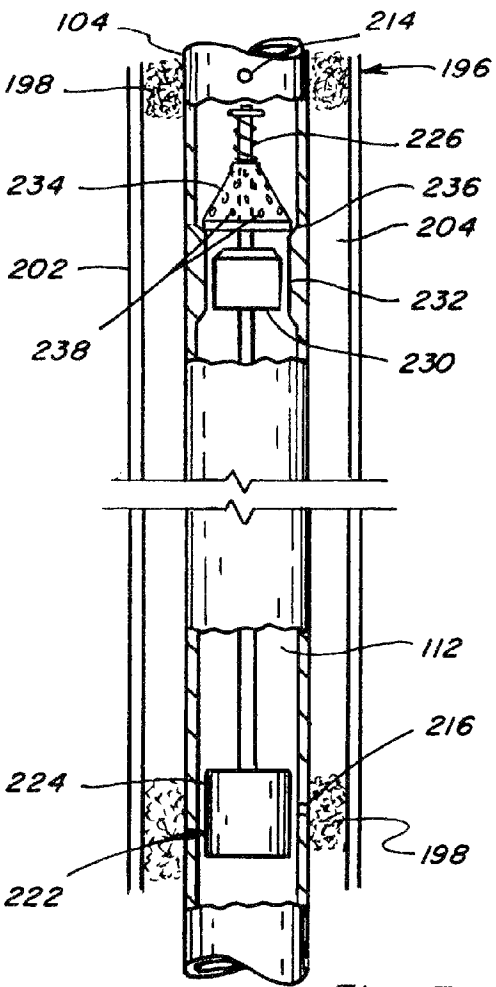
FIG. 17 is still another enlarged fragmentary side view of the apparatus of the invention, illustrating another embodiment of optional closure apparatus in a closed mode for limiting abrasives flow.

FIGS. 14, 15 and 16 illustrate one embodiment 220, and FIGS. 17 and 18 illustrate another embodiment 222 of closure apparatus, constructed and operable for automatically limiting or preventing flow of abrasives 198 from internal cavity 204 of container 202, through second orifice 216, into internal passage 112 of tube 104, when pressurized fluid flow (arrows C) is absent, like parts of apparatus 220 and apparatus 222 being identified by like numbers. Apparatus 220 and 222 are each disposed in tube 104 about coincident longitudinally with abrasives addition unit 196.

Apparatus 220 and 222 each includes a cover element 224 disposed in a closed or covering mode (FIGS. 14 and 17) in generally covering relation to second orifice 216 for preventing or substantially limiting abrasives flow therethrough, and is movable into an open or uncovered mode (FIGS. 16 and 18) spaced from orifice 216, to allow abrasives flow (denoted by arrows CA) therethrough. Cover element 224 is preferably of cylindrical tubular construction to allow flow of fluid C through internal passage 112 therethrough, in both the closed and open modes. Cover element 224 is biased toward the closed mode by a biasing element 226, which can be, for instance, a spring. Cover element 224 is fixedly mounted on the lower end of and supported by a rod 228 which extends longitudinally within passage 112, the upper end of rod 228 fixedly connecting to a valve member 230, also located in passage 112, in proximity to an internal valve seat 232.

Rod 228 is supported in passage 112 by a support element 234, which, in turn, is supported in a suitable manner such as on a shoulder 236 within passage 112. Support element 234 is configured to support cover element 224, biasing element 226, rod 228 and valve member 230, for longitudinal movement relative to shoulder 236, which can be annular or otherwise configured for this purpose.

Support element 234 is configured so as to allow fluid flow therethrough, such as by provision of orifices 238 therethrough.

Biasing element 226 is preferably disposed about rod 228 and urges valve member 230 upwardly toward a restricted passage or valve seat 232, in opposition to fluid pressure thereagainst resulting from fluid flow toward the nozzle, that is, the operating fluid pressure from fluid flow when drilling (some fluid pressure will also be present if a fluid column or hydrostatic head is present in tube 104 above apparatus 220 or 222, and the biasing element 226 should be selected to have a spring constant sufficient to prevent significant opening of cover element 224 under just a hydrostatic head pressure).

Valve member 230 is preferably a solid cylinder, marginally smaller than seat 232. Valve member 230 is preferably configured and located in or against seat 232 in the absence of the operating fluid pressure, but, when the operating flow pressure is present, e.g., flow rate is sufficient, the fluid flow will act against valve member 230 such that biasing element 226 will resiliently yield, to allow cover element 224 to move to the open or uncovered mode. In this mode, a portion of the fluid flow carrying abrasives (arrows CA) will be allowed to flow from cavity 204 through orifice 216 into passage 112, and to the nozzle for drilling, in the above explained manner. Then, when the pressure is reduced, biasing element 226 will urge valve member 230, rod 228 and cover element 224 into or against seat 232, to move cover element 224 to the closed mode, to prevent or substantially limit the abrasives flow.

Here, it should be noted that valve member 230 is only loosely fitted into seat 232, and cover element 224 is only loosely covering orifice 216. This is advantageous, as it facilitates automatic operation, and prevents binding under different temperature and pressure conditions, and in the presents of abrasives and other particulates and contaminants that may be present in the environment.

As examples of representative fluid pressures (gauge readings at the surface) for generating the operating fluid pressures for drilling with abrasives according to the invention, it is contemplated that pressures of 4000 psi or lower can be used, and, in particular, pressures between about 2000 and about 3000 psi can be used.

Additionally, an acid can be used simultaneously with the abrasive drilling.

It will be understood that changes in the details, materials, steps, and arrangements of parts which have been described and illustrated to explain the nature of the invention will occur to and may be made by those skilled in the art upon a reading of this disclosure within the principles and scope of the invention. The foregoing description illustrates the preferred embodiments of the invention; however, concepts, as based upon the description, may be employed in other embodiments without departing from the scope of the invention. Accordingly, the following claims are intended to protect the invention broadly as well as in the specific form shown.

What is claimed is:

1. Apparatus for forming a lateral passage in earth strata beside a well, comprising:

a tubular element configured to extend downwardly within an interior cavity of the well, the tubular element including an internal passage therethrough;

a down hole unit connected to the tubular element so as to be supportable thereby at a predetermined depth within the interior cavity of the well, the down hole unit including a passage extending therethrough between an upper opening connecting with the internal passage through the tubular element, and a sidewardly facing lateral opening lower than the upper opening positioned and configured so as to face an interior side surface of the well when the down hole unit is positioned at the predetermined depth within the interior cavity of the well;

drilling apparatus disposed in the internal passage of the tubular element and the passage through the down hole unit, the drilling apparatus being configured and operable for extending through the lateral opening for directing a pressurized fluid flow sidewardly against the earth strata or a well casing adjacent to the strata for forming the lateral passage;

an abrasives addition unit connected with the drilling apparatus adjacent to the down hole unit, configured and operable for adding abrasives to the pressurized fluid flow;

wherein the drilling apparatus comprises a flexible tube configured and operable for carrying the pressurized fluid flow through the down hole unit and having a lower end extendable from the lateral opening, and a nozzle carried on the lower end of the tube and configured for directing at least one stream of the pressurized fluid against the strata or the casing for forming the lateral passage therein, and wherein the abrasives addition unit comprises a container supported on the lower end of the tube and having an internal cavity containing the abrasives in connection with an internal passage through the lower end of the tube carrying the fluid flow, such that a portion of the abrasives will be added to the flow; and wherein the internal cavity of the container is connected to the internal passage of the tube by a first orifice at a first location, and a second orifice downstream of the first orifice, such that a portion of the pressurized fluid will flow from the internal passage through the first orifice into the internal cavity, and such that the portion of the flow will mix with and carry some of the abrasives from the internal cavity into the internal passage through the second orifice.

2. Apparatus of claim 1, further comprising a restricted orifice in the internal passage of the tube between the first orifice and the second orifice, and configured and operable for creating a pressure drop in the passage between the first orifice and the second orifice, for facilitating flow of the portion of the flow through the internal cavity.

3. Apparatus of claim 1, further comprising closure apparatus configured and operable for covering at least one of the first orifice and the second orifice when the pressurized fluid flow is absent.

4. Apparatus of claim 3, wherein the closure apparatus includes a biasing element configured and operable for holding a cover element in covering relation to the at least one of the orifices when the pressurized fluid flow is absent, the biasing element being resiliently yieldable responsive to application of a force thereagainst by the pressurized fluid flow for moving the covering element out of the covering relation.

5. Apparatus of claim 1, wherein the abrasives comprise particles selected from a group consisting of sand and garnets.

6. Apparatus of claim 1, wherein the drilling apparatus comprises a fluid powered motor configured to be supported in the internal passage of the tubular element, the motor supporting a flexible tube configured for extending through the passage of the down hole unit and extendable from the lateral opening, the flexible tube having an internal passage therethrough and a lower end carrying a nozzle and configured for directing at least one stream of the pressurized fluid flow against the strata or the casing for forming the lateral passage therein, and wherein the motor is operable for rotating the flexible tube while at least a portion of the fluid flow is directed into the internal passage of the flexible tube, and wherein the abrasives addition unit comprises a container supported on the lower end of the flexible tube, the container having an internal cavity containing the abrasives in connection with the internal passage through the lower end of the tube carrying the fluid flow, such that a portion of the abrasives will be added to the flow.

7. Apparatus of claim 6, wherein the motor is configured to be movable within the tubular element for advancing the flexible tube and the nozzle against the formation and withdrawing the tube from the lateral passage.

8. Apparatus of claim 7, wherein the motor is a fluid motor powered by the pressurized fluid and operable for directing the pressurized fluid flow into the flexible tube.

9. Apparatus for forming a lateral passage in earth strata beside a well, comprising:

a tubular element configured to extend downwardly within an interior cavity of the well, the tubular element including an internal passage therethrough;

a down hole unit connected to the tubular element so as to be supportable thereby at a predetermined depth within the interior cavity of the well, the down hole unit including a passage extending therethrough between an upper opening connecting with the internal passage through the tubular element, and a sidewardly facing lateral opening lower than the upper opening positioned and configured so as to face an interior side surface of the well when the down hole unit is positioned at the predetermined depth within the interior cavity of the well;

drilling apparatus disposed in the internal passage of the tubular element and the passage through the down hole unit, the drilling apparatus including a motor configured to be supported in the internal passage of the tubular element, the motor supporting a flexible tube configured for extending through the passage of the down hole unit and extendable from the lateral opening, the flexible tube having an internal passage therethrough and a lower end carrying a nozzle and configured for directing at least one stream of the pressurized fluid against the strata or the casing for forming the lateral passage therein, and wherein the motor is operable by the pressurized fluid for rotating the flexible tube while at least a portion of the fluid flow is directed into the internal passage of the flexible tube;

an abrasives addition unit including a container supported on the lower end of the flexible tube and having an internal cavity containing abrasives in connection with the internal passage through the lower end of the tube carrying the fluid flow, the container and the flexible tube being configured such that a portion of the abrasives will be added to the flow of the fluid through the tube; and wherein the internal cavity of the container is connected to the internal passage of the flexible tube by a first orifice at a first location, and a second orifice downstream of the first orifice, such that a portion of the pressurized fluid will flow from the internal passage through the first orifice into the internal cavity, and such that the portion of the flow will mix with and carry some of the abrasives from the internal cavity into the internal passage through the second orifice.

10. Apparatus of claim 9, further comprising a restricted orifice in the internal passage of the tube between the first orifice and the second orifice, and configured and operable for creating a pressure drop in the passage between the first orifice and the second orifice, sufficient for causing the portion of the flow through the internal cavity.

11. Apparatus of claim 9, further comprising closure apparatus configured and operable for covering at least one of the first orifice and the second orifice when the pressurized fluid flow is absent.

12. Apparatus of claim 11, wherein the closure apparatus includes a biasing element configured so as to be automatically operable for holding a cover element in covering relation to the at least one of the orifices when the pressurized fluid flow is absent, the biasing element being resiliently yieldable responsive to application of a force thereagainst by the pressurized fluid flow for automatically moving the covering element out of the covering relation.

13. Apparatus of claim 9, wherein the abrasives comprise particles selected from a group consisting of sand and garnets.

14. Apparatus of claim 9, wherein the motor is configured to be movable within the tubular element for advancing the flexible tube and the nozzle against the formation and withdrawing the tube from the lateral passage.

15. Apparatus of claim 9, wherein the motor is operable for directing the pressurized fluid flow into the flexible tube.

16. A method for forming a lateral passage in earth strata beside a well, comprising steps of:

providing a tubular element extending downwardly within an interior cavity of the well, the tubular element including an internal passage therethrough;

providing a down hole unit connected to and supported by the tubular element at a predetermined depth within the interior cavity of the well, the down hole unit including a passage extending therethrough between an upper opening connecting with the internal passage through the tubular element, and a sidewardly facing lateral opening lower than the upper opening positioned and facing an interior side surface of the well at the predetermined depth within the interior cavity of the well;

providing drilling apparatus disposed in the internal passage of the tubular element and the passage through the down hole unit, the drilling apparatus including a motor supported in the internal passage of the tubular element, the motor supporting a flexible tube extending through the passage of the down hole unit and extendable from the lateral opening, the flexible tube having an internal passage therethrough and a lower end carrying a nozzle and configured for directing at least one stream of the pressurized fluid against the strata or the casing for forming the lateral passage therein, the motor being operable by the pressurized fluid for rotating the flexible tube while at least a portion of the fluid flow is directed into the internal passage of the flexible tube;

providing an abrasives addition unit including a container supported on the lower end of the flexible tube and having an internal cavity containing abrasives in connection with the internal passage through the lower end of the tube carrying the fluid flow, the container and the flexible tube being configured such that a portion of the abrasives will be added to the flow of the fluid through the tube;

operating the motor for rotating the nozzle while directing the pressurized fluid flow carrying the abrasives through the nozzle and against the earth strata or a well casing adjacent thereto; and wherein the internal cavity of the container is connected to the internal passage of the flexible tube by a first orifice at a first location, and a second orifice downstream of the first orifice, such that a portion of the pressurized fluid will flow from the internal passage through the first orifice into the internal cavity, and such that the portion of the flow will mix with and carry some of the abrasives from the internal cavity into the internal passage through the second orifice.

17. The method of claim 16, wherein the tube comprises a restricted orifice in the internal passage thereof between the first orifice and the second orifice, and configured and operable for creating a pressure drop in the fluid flow through the passage between the first orifice and the second orifice, sufficient for causing the portion of the flow through the internal cavity.

18. The method of claim 16, wherein the tube further comprises a closure apparatus configured and operable for covering at least one of the first orifice and the second orifice when the pressurized fluid flow is absent.

19. The method of claim 18, wherein the closure apparatus includes a biasing element which automatically operates for holding a cover element in covering relation to the at least one of the orifices when the pressurized fluid flow is absent, the biasing element being resiliently yieldable responsive to application of a force thereagainst by the pressurized fluid for automatically moving the covering element out of the covering relation.

* * * * *